US007017833B2

(12) United States Patent
Foster

(10) Patent No.: US 7,017,833 B2
(45) Date of Patent: Mar. 28, 2006

(54) TRIGGER SPRAYER SPRAY, OFF, STREAM, OFF INDEXING NOZZLE ASSEMBLY

(75) Inventor: Donald D. Foster, St. Charles, MO (US)

(73) Assignee: Continental AFA Dispensing Company, St. Peters, MO (US)

( * ) Notice: Subject to any disclaimer, the term of this patent is extended or adjusted under 35 U.S.C. 154(b) by 292 days.

(21) Appl. No.: 10/358,407

(22) Filed: Feb. 4, 2003

(65) Prior Publication Data

US 2004/0149837 A1 Aug. 5, 2004

(51) Int. Cl.

| | |
|---|---|
| ***A62C 11/00*** | (2006.01) |
| ***B05B 9/043*** | (2006.01) |
| ***B05B 1/34*** | (2006.01) |
| ***B67D 5/40*** | (2006.01) |

(52) U.S. Cl. ..... 239/333; 239/477; 239/478; 239/483; 239/493; 222/383.1

(58) Field of Classification Search ..... 239/333, 239/477, 478, 483, 493, 479, 482, 484, 490, 239/491, 492, 505, 506, 507; 222/383.1
See application file for complete search history.

(56) References Cited

U.S. PATENT DOCUMENTS

| | | | | |
|---|---|---|---|---|
| 4,247,048 | A * | 1/1981 | Hayes | 239/396 |
| 4,706,888 | A | 11/1987 | Dobbs | |
| 4,779,803 | A * | 10/1988 | Corsette | 239/428.5 |
| 5,234,166 | A | 8/1993 | Foster et al. | |
| 5,267,692 | A * | 12/1993 | Maas et al. | 239/333 |
| 5,368,234 | A | 11/1994 | Foster et al. | |
| 5,499,766 | A | 3/1996 | Foster et al. | |
| 5,526,985 | A * | 6/1996 | Martin | 239/478 |
| 5,738,282 | A * | 4/1998 | Grogan | 239/492 |
| 5,755,384 | A | 5/1998 | Foster et al. | |

* cited by examiner

*Primary Examiner*—David A. Scherbel
*Assistant Examiner*—Darren Gorman
(74) *Attorney, Agent, or Firm*—Thompson Coburn, LLP

(57) ABSTRACT

An indexing nozzle assembly for a trigger sprayer has a manually rotatable cap mounted for rotation on a liquid spinner of the nozzle assembly. Rotation of a cap changes the nozzle assembly between an off condition, a spray condition, a second off condition, and a stream condition of the liquid discharged from the nozzle assembly. The cap can be rotated from the off position directly to either of the spray or stream positions by rotating the cap one-quarter turn in opposite directions. A spatial relationship between an end surface of the liquid spinner and an interior surface of the cap end wall that surrounds the assembly discharge orifice improves the stream configuration of liquid discharged by the nozzle assembly.

16 Claims, 7 Drawing Sheets

TRIGGER SPRAYER SPRAY, OFF, STREAM, OFF INDEXING NOZZLE ASSEMBLY

BACKGROUND OF THE INVENTION (1) Field of the Invention

The present invention pertains to a hand-held and hand-operated liquid sprayer typically called a trigger sprayer. In particular, the present invention pertains to an indexing nozzle assembly for a trigger sprayer that has a manually rotatable cap mounted for rotation on a liquid spinner of the nozzle assembly. Rotation of the cap changes the nozzle assembly between an off condition, a spray condition, a second off condition, and a stream condition of liquid discharged from an orifice of the nozzle assembly in one continuous rotation of the cap. In addition, the spatial relationship between an end surface of the liquid spinner and an interior wall of the cap that surrounds the discharge orifice improves the stream configuration of the liquid discharged by the nozzle assembly.

(2) Description of the Related Art

Hand-held and hand-operated liquid sprayers commonly known as trigger sprayers are well known in the liquid sprayer art. Trigger sprayers are commonly used to dispense household cleaning or cooking liquids in a stream pattern, a spray pattern, or as a foam. A trigger sprayer is typically connected to a plastic bottle containing the liquid dispensed by the trigger sprayer.

A typical trigger sprayer is comprised of a sprayer housing that is connected to a neck of the liquid containing bottle by either a treaded connection or a bayonet-type connection. The sprayer housing is formed with a pump chamber, a vent chamber, a liquid discharge passage communicating the pump chamber with a discharge orifice of the trigger sprayer and a liquid supply passage communicating the pump with a dip tube that extends into the liquid of the bottle when the trigger sprayer housing is attached to the bottle neck.

A pump piston is mounted in the pump chamber for reciprocating movements of the pump piston between charge and discharge positions relative to the pump chamber. A vent piston is often connected to the pump piston and is mounted in the vent chamber for reciprocating movements of the vent piston between a closed venting position and an open venting position of the vent piston relative to the vent chamber. A spring is usually provided in the sprayer housing pump chamber for biasing the pump piston and the vent piston toward their respective charge and closed positions.

A trigger is mounted on the sprayer housing by a pivot connection at one end of the trigger. The trigger is also connected to the pump piston and the vent piston. Repeating the sequence of manually squeezing the trigger toward the sprayer housing against the bias of the pump chamber spring, and then releasing the trigger oscillates the trigger about its pivot connection and reciprocates the pump piston between its charge and discharge positions relative to the pump chamber as well as reciprocates the vent piston between its closed and opened positions relative to the vent chamber.

A pair of check valves or one-way valves are assembled in the sprayer housing. One of the check valves is provided in the sprayer housing between the pump chamber and the liquid supply passage. This valve controls the flow of liquid from the dip tube and through the supply passage to the pump chamber and prevents the reverse flow of liquid from the pump chamber to the dip tube. The second check valve is positioned between the pump chamber and the liquid discharge passage. This valve controls the flow of liquid from the pump chamber to the liquid discharge passage and prevents the reverse flow of liquid from the liquid discharge passage to the pump chamber.

A nozzle assembly having a discharge orifice is assembled to the sprayer housing at the outlet of the liquid discharge passage. The liquid discharge passage usually contains a liquid spinner assembly. The spinner assembly has a swirl chamber at one end of the spinner assembly adjacent the nozzle orifice.

In trigger sprayers having selectable discharge conditions, the nozzle assembly includes a cap that is mounted over the spinner assembly. The cap is rotatable between an off position where discharge from the nozzle assembly is prevented, a spray position where the discharge of liquid from the nozzle orifice is in a spray pattern, a stream position where the discharge of liquid is in a stream pattern, and/or a foam position where the discharge of liquid is converted to a foam.

From the manual oscillating movement of the trigger that reciprocates the pump piston in the pump chamber, the liquid is drawn from the bottle through the dip tube past the first check valve to the pump chamber. The liquid is then pumped from the pump chamber through the liquid discharge passage and the second check valve to the liquid spinner and the discharge orifice and is dispensed from the trigger sprayer. By rotating the nozzle assembly cap, the trigger sprayer can be changed from an off condition where discharge is prevented, to a spray condition where the discharge is as a spray, to a stream condition where the discharge is as a stream, and/or to a foam condition where the discharge is as a foam.

The typical trigger sprayer described above has the cap mounted on the nozzle assembly of the sprayer for rotation of the cap in only one direction. Movement of the cap from the off position to one of the spray, stream, or foam positions often requires rotating the cap through an undesired spray, stream, or foam position. For example, if it is desired to discharge liquid from the trigger sprayer as a stream, it is often necessary to move the cap from the off position through the spray position to move the cap to the stream position. In addition, to move the cap back to its off position when use of the trigger sprayer is finished, it is necessary again to rotate the cap from the stream position through the spray position to move the cap to the off position.

Use of trigger sprayers of this type often results in discharging liquid from the trigger sprayer in a condition that wasn't intended. For example, discharging the liquid as a spray covering a large area with the liquid when it was desired to discharge the liquid as a stream directed to only a small area. Furthermore, when use of the trigger sprayer is finished, the cap at times will not be rotated far enough to position it in the off position. This could result in the liquid leaking from the trigger sprayer when it is stored if the trigger sprayer should be knocked over onto its side.

SUMMARY OF THE INVENTION

The indexing sprayer nozzle assembly of the present invention overcomes disadvantages associated with prior art nozzle assemblies by providing a cap on the nozzle assembly that can be rotated in either direction to move the cap from an off position to either a spray or stream position. In addition, the cap can be rotated in either direction from the spray or stream position to reposition the nozzle cap in an off position. Still further, the indexing nozzle assembly has a spatial relation between an end surface of the spinner head of the assembly and an interior surface of the nozzle cap that surrounds the discharge orifice of the assembly that improves the stream condition of the liquid discharge.

The trigger sprayer of the present invention has an indexing nozzle assembly of novel construction that can be used on various different types of constructions of trigger sprayer assemblies. As an illustrated example, the indexing nozzle assembly of the invention is employed on a trigger sprayer housing that is similar to sprayer housings of the prior art in that it comprises a pump chamber, a vent chamber, a liquid discharge passage and a liquid supply passage. A dip tube communicates the liquid supply passage with the interior of a bottle containing the liquid to be dispensed.

The indexing nozzle assembly of the invention is mounted to the trigger sprayer at the outlet end of the sprayer housing discharge passage. The nozzle assembly is basically comprised of a nozzle base and a nozzle cap. The nozzle is mounted to the nozzle base for free rotation in either a clockwise or counterclockwise direction. The nozzle base can be a separate component part assembled to the sprayer housing or could be an integral part of the sprayer housing.

The nozzle base contains a liquid passage that communicates with the liquid discharge passage of the sprayer housing. A liquid spinner shaft is positioned in the nozzle base liquid passage with portions of the liquid passage surrounding the spinner shaft. The spinner shaft has a distal end with a spinner shaft end surface. A swirl chamber is recessed into the spinner shaft end surface. A plurality of angled channels extend radially outwardly from the swirl chamber to the exterior surface of the spinner shaft. An additional plurality of straight channels extend radially outwardly from the swirl chamber to the exterior surface of the spinner shaft. Axial grooves are recessed into the exterior surface of the spinner shaft and are axially aligned with the angled radial channels and the straight radial channels at the distal end of the spinner shaft.

The nozzle cap has an end wall that extends across the swirl chamber of the spinner shaft. The discharge orifice passes through the end wall. The end wall has a interior surface that is spaced from the spinner shaft end surface. The spacing of the end wall interior surface from the spinner shaft end surface effectively increases the interior volume of the swirl chamber.

The nozzle cap has an inner cylindrical section that projects from the cap end wall and engages in a sliding sealing engagement around the liquid spinner shaft. The interior surface of the cap inner cylindrical section has a plurality of grooves. By rotating the cap on the nozzle base, the grooves of the cap inner cylindrical section align with the angled channels of the liquid spinner, or with the straight channels of the liquid spinner, or do not align with any of the channels of the liquid spinner.

In use of the indexing nozzle assembly of the invention, with the nozzle cap positioned in the off position on the nozzle base the grooves in the inner cylindrical section of the nozzle cap are not aligned with either the angled channels or the straight channels of the liquid spinner. In this position of the nozzle cap, the trigger sprayer will not dispense liquid on manual manipulation of the trigger. When the nozzle cap is rotated to its spray position, the grooves in the inner cylindrical section of the nozzle cap are aligned with the angled channels of the liquid spinner. This results in liquid being dispensed in a spray pattern when the trigger of the trigger sprayer is manually manipulated. Rotating the nozzle cap to its stream position aligns the grooves in the inner cylindrical section of the nozzle cap with the straight channels of the liquid spinner. This results in liquid being discharged in a stream from the trigger sprayer when the trigger is manually manipulated. Furthermore, the axial spacing between the spinner shaft end surface and the cap end wall interior surface provides an additional volume adjacent the swirl chamber of the liquid spinner that enhances the stream configuration of the liquid dispensed from the trigger sprayer.

The nozzle cap is mounted to the nozzle base so that the nozzle cap can be rotated in a clockwise or counterclockwise direction to position the cap in any of its off, spray, or stream positions. Furthermore, the axial grooves in the nozzle cap are positioned so that the nozzle cap can be moved to an off condition by one-quarter turn of the nozzle cap in either direction from either its spray position or its stream position, thus simplifying use of the nozzle cap.

DESCRIPTIONS OF THE DRAWING FIGURES

Further features of the invention are set forth in the following detailed description of the preferred embodiment of the invention and in the drawing figures wherein.

DETAILED DESCRIPTION OF THE PREFERRED EMBODIMENT

Figure 7:
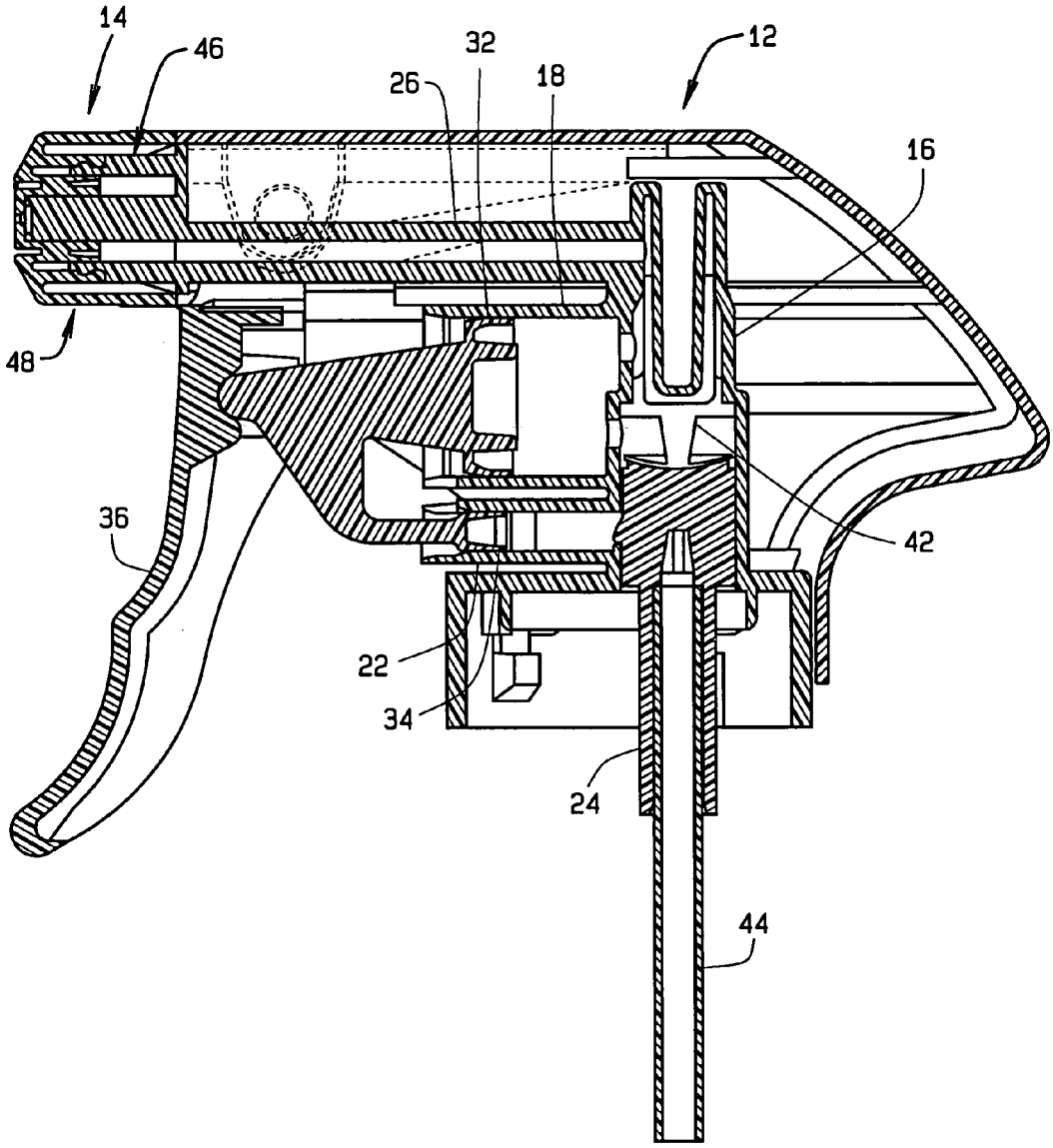
FIG. 7 is a cross section of a trigger sprayer construction with which the indexing nozzle assembly of the invention may be employed.

The trigger sprayer of the present invention is provided with a novel indexing nozzle assembly that can be employed on various different types of trigger sprayers. The indexing nozzle assembly of the invention changes the condition of the liquid discharge of the trigger sprayer between a closed condition, a spray condition, or a stream condition. The unique features of the indexing nozzle assembly can be incorporated into a variety of different types of hand-held and hand-operated trigger sprayers. FIG. 7 shows one example of a trigger sprayer 12 with which the indexing nozzle assembly 14 of the invention may be used. However, it should be understood that the trigger sprayer 12 shown in FIG. 7 is only one example of a trigger sprayer with which the indexing nozzle assembly 14 of the invention may be used. Because the operation of the indexing nozzle assembly 14 does not require any particular trigger sprayer construction, the trigger sprayer 12 of FIG. 7 is described only generally herein.

The trigger sprayer 12 of FIG. 7 is similar to other prior art trigger sprayers and is basically comprised of a sprayer housing 16 that contains a pump chamber 18, a vent chamber 22, a liquid supply passage 24, and a liquid discharge passage 26.

A pump piston 32 is mounted in the pump chamber 18 for reciprocating movements of the piston between charge and discharge positions of the piston relative to the pump chamber. A vent piston 34 is connected to the pump piston 32. The vent piston 34 is mounted in the vent chamber 22 for reciprocating movement between vent open and vent closed positions relative to the vent chamber. When the pump piston 32 is moved inwardly in the pump chamber 18 toward its discharge position, the vent piston 34 is also moved inwardly in the vent chamber 22 toward its open vent position. When the pump piston 32 moves outwardly from the pump chamber 18 toward its charge position, the vent piston 34 also moves outwardly relative to the vent chamber 32 to its vent closed position. A coil spring (not shown) is typically positioned in the pump chamber 18 and engages against the pump piston 32 biasing the pump piston toward its charge position relative to the pump chamber 18. Thus, the spring also biases the vent piston 34 toward its vent closed position relative to the vent chamber 22.

A manually manipulated trigger 36 is mounted to the sprayer housing 16 for pivoting movement. The trigger 36 is also connected to the pump piston 32 and to the vent piston 34. Manual manipulation of the trigger 36 moves the pump piston 32 between its charge and discharged positions, and moves the vent piston 34 between its vent closed and vent open positions, as is conventional.

The trigger sprayer 12 shown in FIG. 7 also includes a unique double valve assembly 42. The double valve assembly 42 separates the liquid supply passage 24 from the liquid discharge passage 26. A dip tube 44 communicates the liquid supply passage 24 with the interior of a liquid containing bottle (not shown) to which the trigger sprayer 12 is attached. On manual manipulation of the trigger 36, liquid is drawn through the dip tube 44 from the bottle and to the pump chamber 18. The liquid is then pumped from the pump chamber 18 through the liquid discharge passage 26 prior to it being discharged from the trigger sprayer. The trigger sprayer 12, the double valve assembly 42, and their operation are described in co-pending application Ser. No. 10/288,944, filed Nov. 6, 2002, which is assigned to the assignee of the present application and is incorporated herein by reference.

Figure 1:
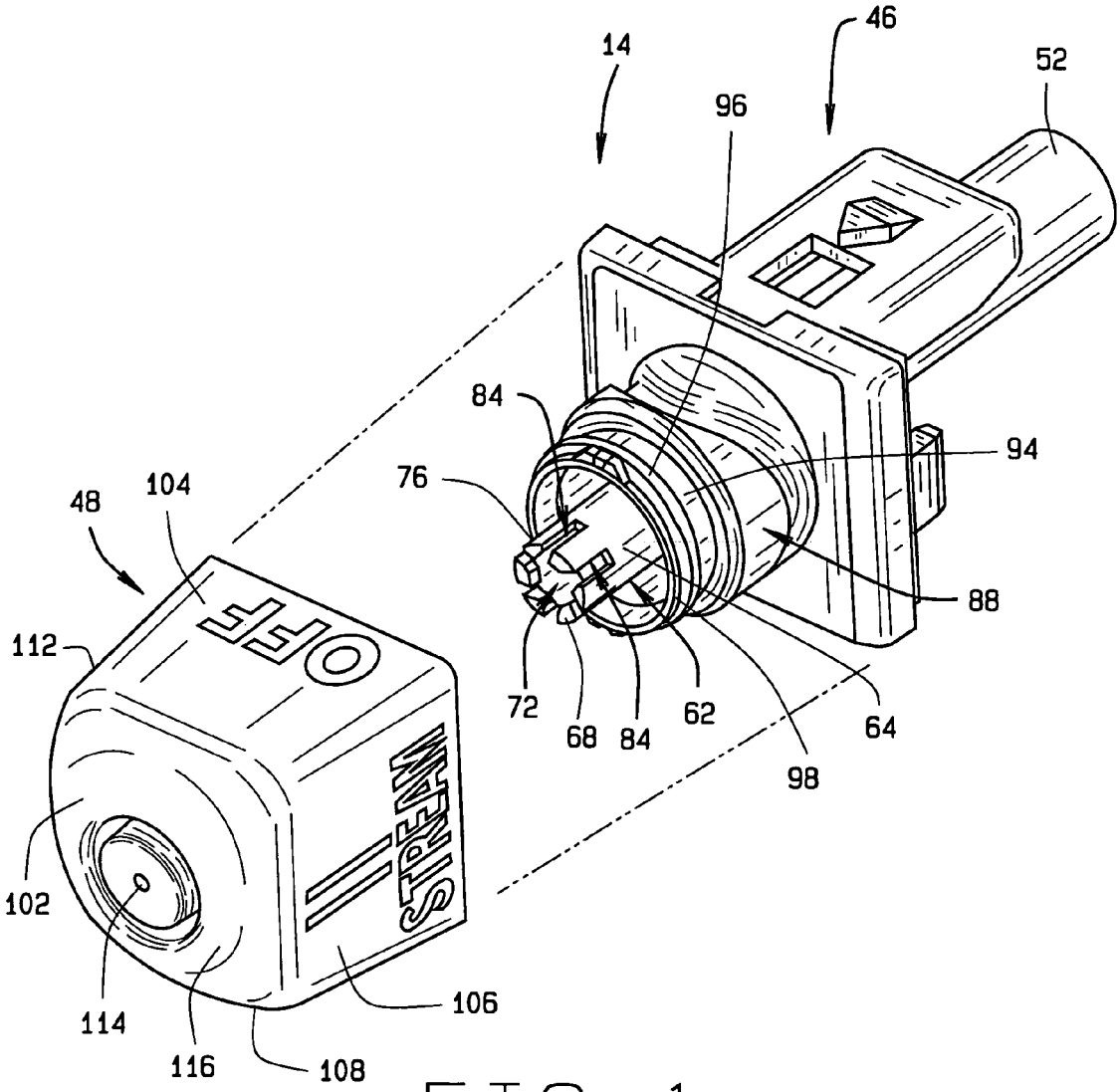
FIG. 1 is a prospective view of the two basic component parts of the indexing sprayer nozzle assembly of the invention.
Figure 2:
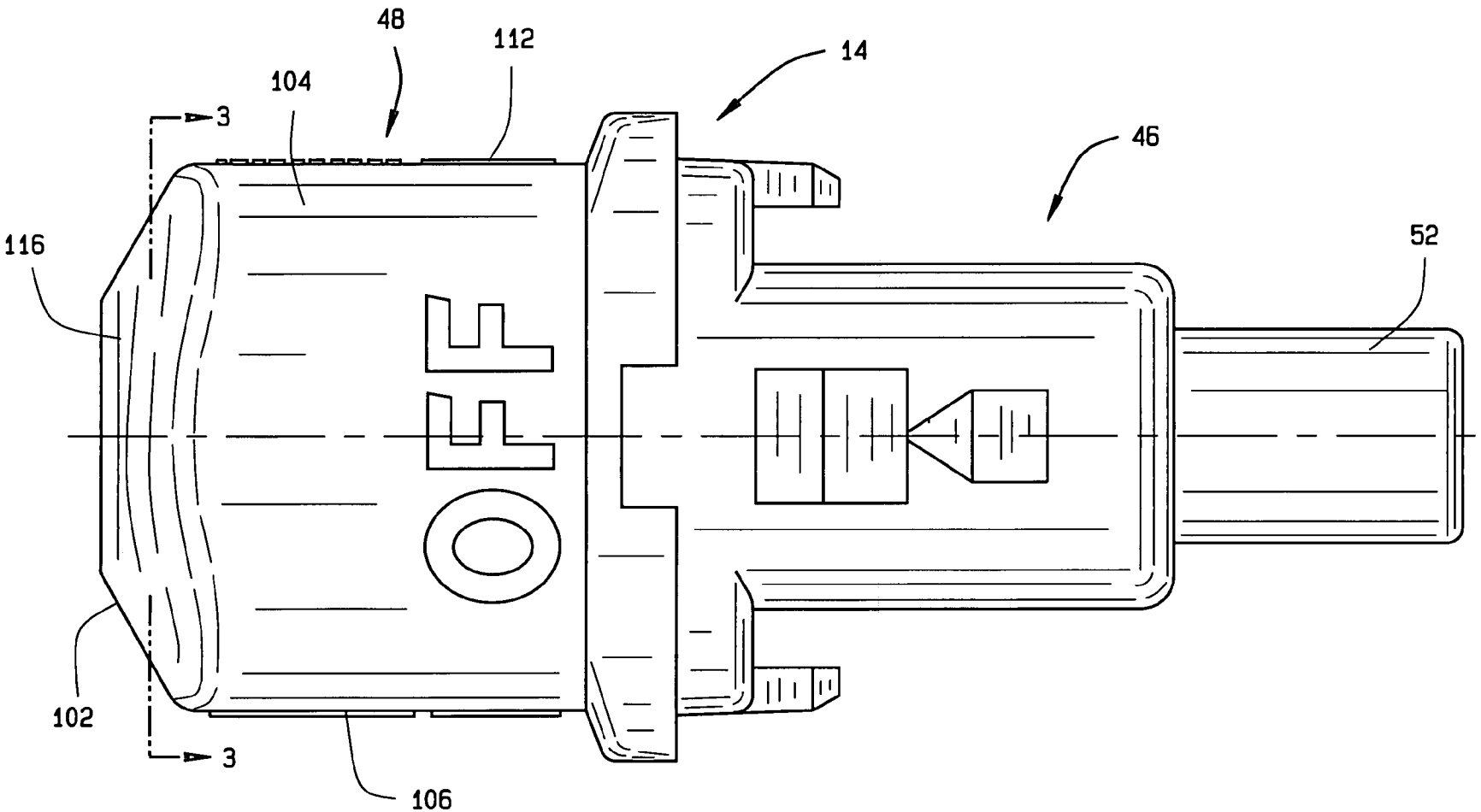
FIG. 2 is a top plan view of the nozzle assembly of FIG. 1.
Figure 4:
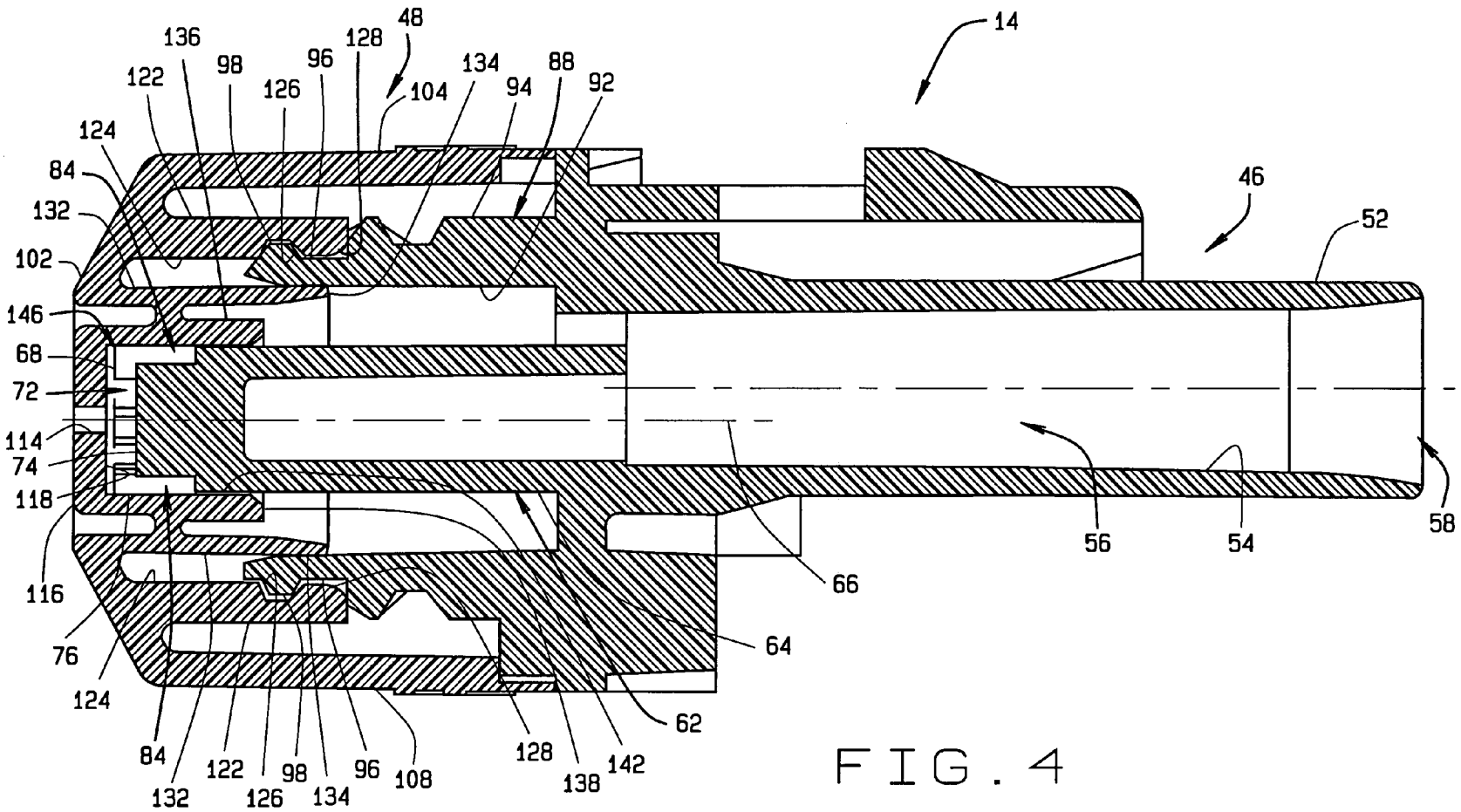
FIG. 4 is a cross section side elevation view of the nozzle assembly along the line 4—4 of FIG. 3.

The indexing nozzle assembly 14 of the present invention is basically comprised of a nozzle base 46 and a nozzle cap 48. The nozzle cap 48 is mounted to the nozzle base 46 for free rotation in either a clockwise or counterclockwise direction around the nozzle base. In FIG. 7 the nozzle base 46 is shown as an integral part of the sprayer housing 16. Alternatively, the nozzle base 46 as shown in FIGS. 1, 2 and 4, is a separate component part of the trigger sprayer 12 that is assembled to the sprayer housing 16 at the liquid discharge passage 26. Thus, the nozzle base 46 can be a separate component part assembled to the sprayer housing 16 or could be an integral part of the sprayer housing.

The nozzle assembly to be described includes the nozzle base 46 that is a separate component part of the trigger sprayer and is assembled to the trigger sprayer housing. The nozzle base 46 is provided with a discharge tube 52 at one end of the base. The discharge tube 52 has an exterior surface that is dimensioned to be received in the outlet opening of the liquid discharge passage of the trigger sprayer housing when assembling the nozzle base to the sprayer housing. The discharge tube 52 has a cylindrical interior surface 54 that surrounds a liquid passage extending through the nozzle base 46. The liquid passage 56 extends from an inlet opening 58 at one end of the nozzle base 46 in a downstream direction toward the nozzle cap 48 mounted on the nozzle base.

The nozzle base 46 includes a liquid spinner shaft 62 positioned in the liquid passage 56. The spinner shaft 62 has a cylindrical exterior surface 64 with a center axis 66. The spinner shaft 62 extends axially in the downstream direction to a circular end surface 68 of the spinner shaft.

A liquid swirl chamber is formed in the liquid spinner shaft end surface 68. The construction of the swirl chamber is basically the same as that of prior art liquid spinners employed in trigger sprayers. The swirl chamber is formed as a cylindrical cavity 72 that is recessed into the spinner shaft end surface 68. The cavity 72 extends from the spinner shaft end surface 68 into the spinner shaft to a swirl chamber end surface 74 positioned axially inside the spinner shaft from the spinner shaft end surface 68. The swirl chamber cavity 72 in the spinner shaft end surface 68 defines an annular wall 76 of the spinner shaft that extends around the cavity.

A plurality of channels extend radially outwardly from the swirl chamber cavity 72 through the annular wall 76 to the exterior surface 64 of the spinner shaft. In the preferred embodiment there are six channels extending through the swirl chamber annular wall 76. The six channels can be seen in FIGS. 1, 3, 5 and 6. The channels include three straight channels 78 that extend radially outwardly through the annular wall 76 and intersect the liquid spinner center axis 66, and three angled channels 82 that extend radially outwardly through the annular wall 76 and do not intersect the liquid spinner center axis 66.

The straight channels 78 and the angled channels 82 also have axial extensions across the liquid spinner exterior surface 64 that form axial grooves 84 in the liquid spinner exterior surface. The axial grooves 84 in the liquid spinner exterior surface 64 are axially aligned with the straight radial channels 78 and the angled radial channels 82 at the distal end of the spinner shaft.

The nozzle base 46 includes a cylindrical cap support 88 that is spaced radially outwardly from and extends axially along a portion of the liquid spinner shaft 62. The cylindrical cap support has a cylindrical interior surface 92 that surrounds the spinner shaft 62 and a portion of the liquid passage 56 that extends axially across the spinner shaft exterior surface 64. The cap support 88 has an opposite cylindrical exterior surface 94. An exterior annular groove 96 is recessed into the exterior surface of the cap support 88. The annular groove 96 forms an exterior annular collar 98 that extends around the cylindrical cap support 88 at the distal end or downstream end of the support.

The nozzle cap 48 as an exterior configuration with a general cube shape defined by a cap end wall 102 and four cap side walls 104, 106, 108, 112. The four side walls of the cap have indicia that indicate the different conditions of the nozzle assembly when the cap is rotated to different positions on the base. One of the cap side walls 104 is provided with an "off" indicia, another of the side walls 106 is provided with a "stream" indicia, another of the side walls 108 is provided with an "off" indicia, and the last of the cap side walls is provided with a "spray" indicia. The two side walls 104, 108 bearing the "off" indicia are on opposite sides of the nozzle cap 48, and the two side walls 106, 112 having the "stream" and "spray" indicia are positioned on opposite sides of the nozzle cap 48. The nozzle cap end wall 12 has a cylindrical discharge orifice 114 that passes through the end wall from an exterior surface 116 of the end wall to an interior surface 118 of the end wall. The discharge orifice 114 is coaxially aligned with the center axis 66 of the spinner shaft 62.

There is an axial spacing between the end wall interior surface 118 and the spinner shaft end surface 68. Optimum performance of the trigger sprayer is achieved when the axial spacing between the liquid spinner and the nozzle cap interior surface is from about 0.001 to about 0.010 of an inch. In the preferred embodiment the axial spacing is about 0.009 of an inch.

The nozzle cap 48 has an outer coupling cylinder 122 in its interior that extends axially inwardly from the interior surface 118 of the nozzle cap end wall 102. The outer coupling cylinder 122 has a cylindrical interior surface 124 with an interior annular groove 126 formed in the interior surface. The coupling cylinder interior annular groove 126 defines an interior annular collar 128 adjacent the groove and at the distal end of the coupling cylinder 122. As shown in FIG. 4, the coupling cylinder annular groove 126 receives the exterior annular collar 98 of the nozzle base cap support 88. In addition, the exterior annular groove 96 of the nozzle base cap support 88 receives the interior annular collar 128 of the nozzle cap. This attaches the nozzle cap 48 to the nozzle base 46 for free rotation of the cap relative to the base about the center axis 66 of the cap discharge orifice 114 and the nozzle base liquid spinner 62. The attachment between the nozzle cap 48 and the nozzle base 46 permits the nozzle cap 48 to rotate for more than one complete rotation in either the clockwise direction or the counterclockwise direction around the nozzle base.

A cylindrical seal 132 is provided in the interior of the nozzle cap 48. The cylindrical seal 132 projects axially inwardly from the nozzle cap end wall interior surface 118 to a distal end portion 134 of the seal. As seen in FIG. 4, the cylindrical seal 132 distal end portion 134 is flared slightly radially outwardly. The distal end portion 136 engages in a sliding sealing engagement with the interior surface 92 of the nozzle base cap support 88.

The nozzle cap 48 also has an inner cylindrical wall 136 radially inside the cylindrical seal 132 of the cap. The inner cylindrical wall 136 projects axially from the interior surface 118 of the nozzle cap end wall 102 to a distal end 138 of the cylindrical wall. The cylindrical wall has a cylindrical interior surface 142 that engages in a sliding sealing engagement around the liquid spinner exterior surface 64. The inner cylindrical wall interior surface 142 intersects the cap end wall interior surface 118 at a right angle. The cap end wall interior surface 118 is a flat circular surface within the inner cylindrical wall interior surface 142 that is only interrupted by the discharge orifice 114. The inner cylindrical wall 136 has a plurality of axial grooves 144 formed in the wall interior surface 142. The axial grooves 144 are shown as dashed lines in FIGS. 3, 5 and 6. Each of the axial grooves 144 has a length that intersects with the distal end 138 of the inner cylindrical wall. The grooves 144 communicate the liquid passage 56 of the nozzle base 46 with the grooves 84 of the liquid spinner shaft 62 when the grooves 144 of the nozzle cap cylindrical wall 136 are aligned with the grooves 84 of the nozzle base liquid spinner shaft 62.

An important feature of the invention is the axial positioning of the nozzle cap 48 relative to the nozzle base 46. As best seen in FIG. 4, with the nozzle cap 48 mounted for rotation on the nozzle base 46, an axial spacing 146 is left between the spinner shaft end surface 68 of the nozzle base and the end wall interior surface 118 of the nozzle cap. The spacing 146 creates an additional interior volume adjacent the interior volume of the swirl chamber cavity 72. This additional interior volume provided by the spacing 146 enhances the ability of the indexing nozzle assembly 14 to discharge liquid passed through the nozzle assembly in a stream condition or a stream pattern of discharge.

Figure 3:
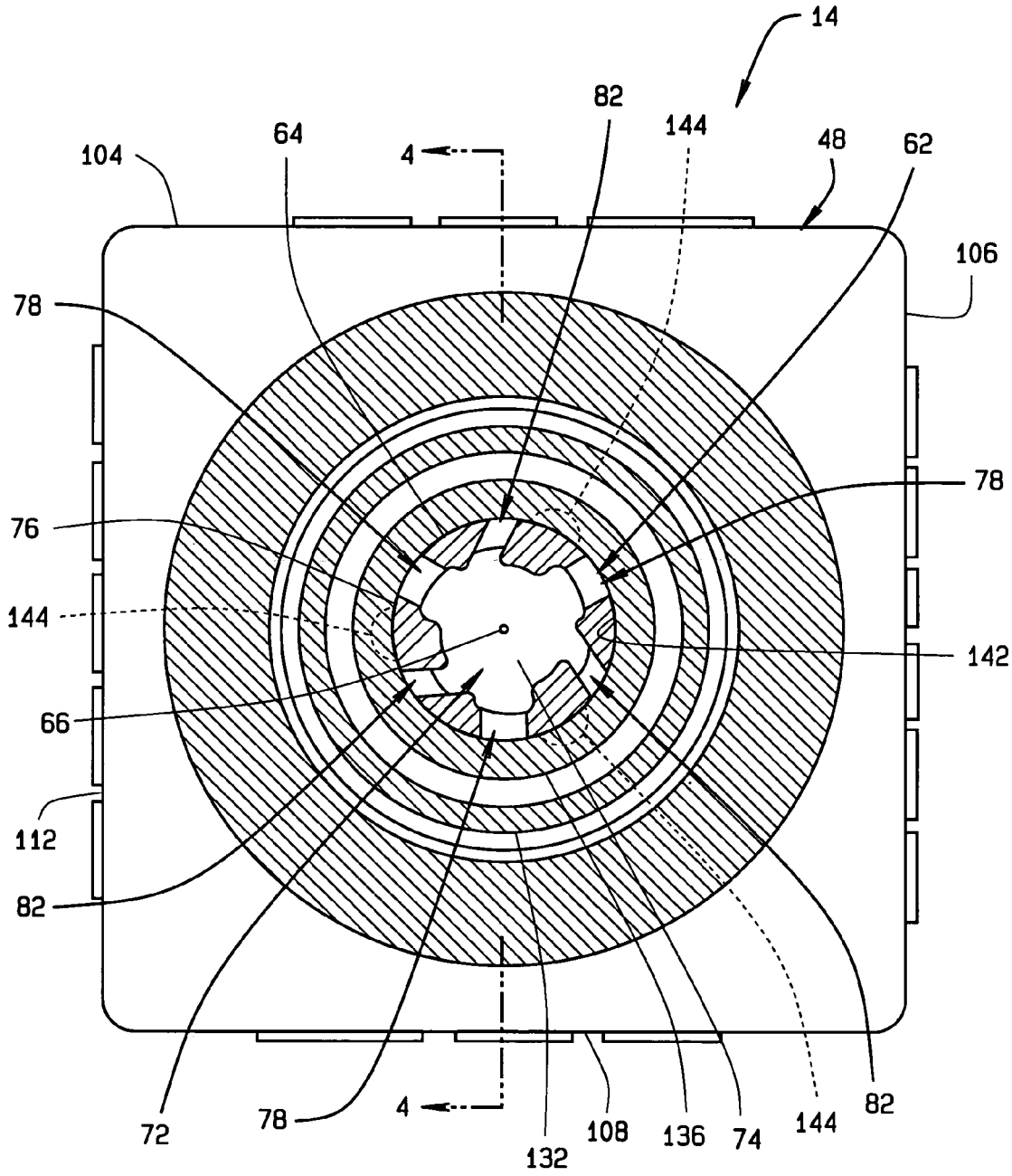
FIG. 3 is a partial cross section end elevation view of the nozzle assembly along the line 3—3 of FIG. 2.

In operation of the indexing nozzle assembly 14, from its off condition shown in FIGS. 3 and 4, the nozzle cap 48 need only be rotated 90 degrees or one-quarter of a revolution in the clockwise direction or the counterclockwise direction to move the cap to the spray or stream position, respectively. In the cross section of FIG. 3, the nozzle cap is in its off position and liquid flow through the indexing nozzle assembly 14 is stopped by the nozzle cap. As seen in FIG. 3, the axial grooves 144 of the nozzle cap inner cylindrical wall are not aligned with either the straight channels 78 or the angled channels 82 of the nozzle base liquid spinner shaft 62. Thus, any liquid pumped through the trigger sprayer employing the indexing nozzle assembly 14 of the invention will be stopped before it reaches the liquid spinner shaft swirl chamber 72.

Figure 5:
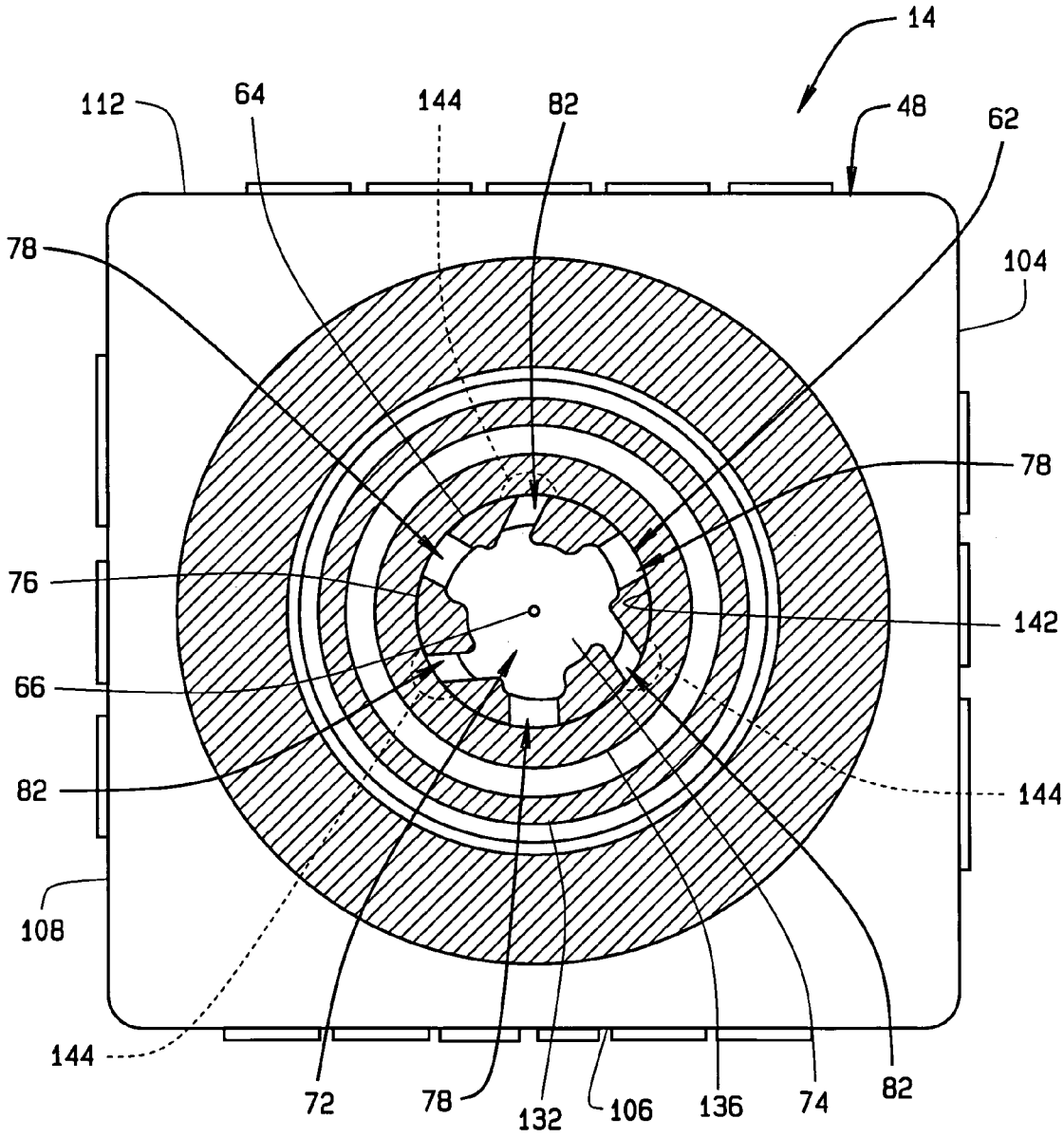
FIG. 5 is a partial cross section and elevation view similar to FIG. 3, but with the cap of the nozzle assembly rotated to its spray position.

FIG. 5 shows a cross section of the indexing nozzle assembly 14 similar to that of FIG. 3, but in FIG. 5 the nozzle cap 48 has been rotated one-quarter of a turn in the clockwise direction from the off position. This moves the nozzle cap 48 to the spray position relative to the nozzle base 46. The axial grooves 144 in the interior surface of the nozzle cap inner cylindrical wall 136 are aligned with the axial groove 84 on the spinner shaft exterior surface 64 and with the angled channels 82 through the swirl chamber annular wall 76. Liquid pumped through the liquid passage 56 by the trigger sprayer will pass through the aligned axial grooves 144 of the cap inner cylindrical wall 136 and the spinner grooves 84 of the base spinner shaft 62 and will pass through the angled channels 82 into the swirl chamber cavity 72. The angled orientation of the angled channels 82 creates a spin in the liquid that enters the swirl chamber 72 just prior to the liquid being discharged through the discharge orifice 114. This spin in the liquid gives the liquid a spray pattern as it is discharged out of the indexing nozzle assembly 14 through the discharge orifice 114.

Figure 6:
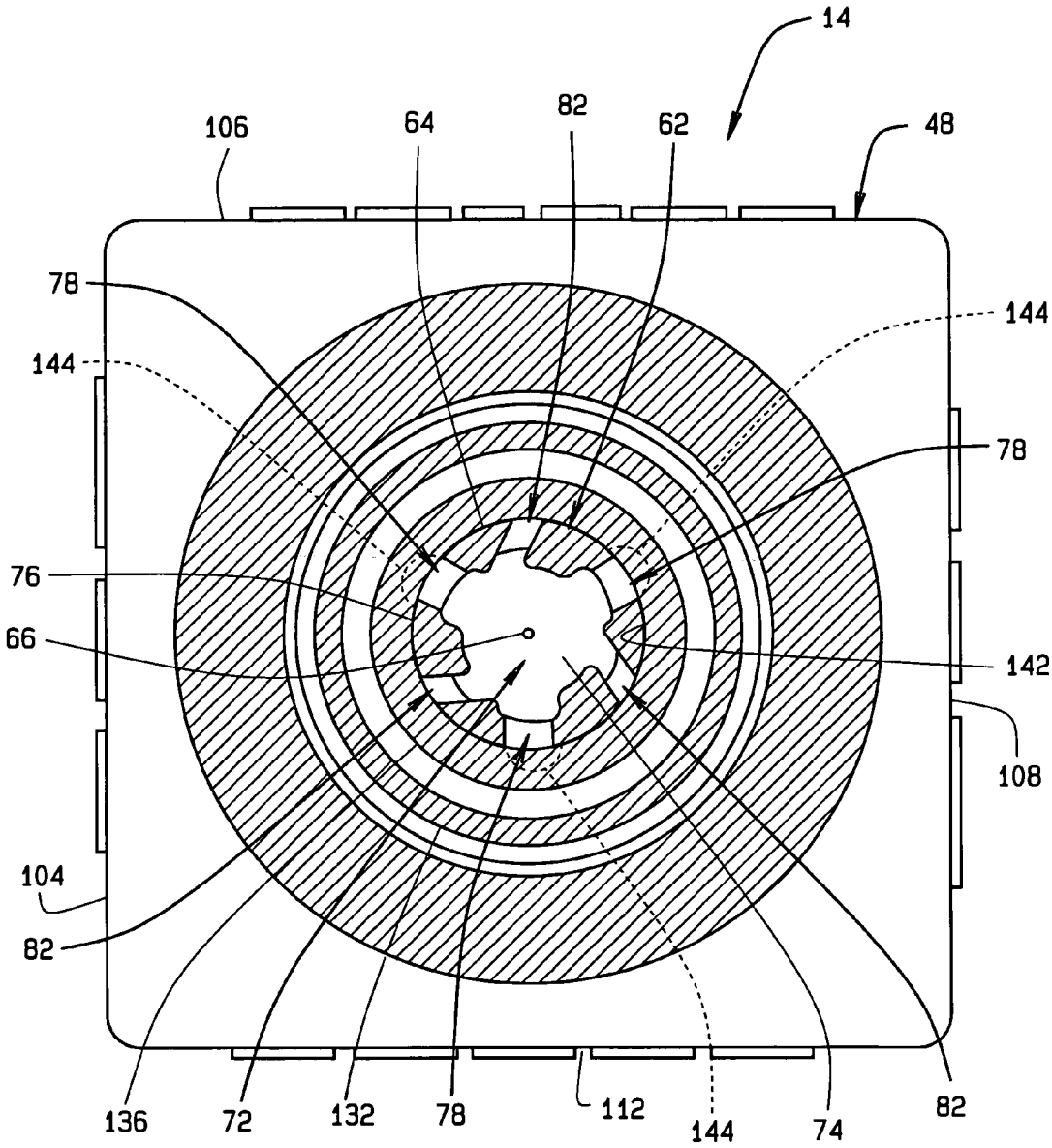
FIG. 6 is a view similar to that of FIG. 5, but with the cap of the nozzle assembly rotated to its stream position.

FIG. 6 shows a cross section of the indexing nozzle assembly similar to that of FIG. 3, but in FIG. 6 the nozzle cap 48 has been rotated counterclockwise one-quarter turn from the off position to the stream position of the cap relative to the nozzle base. In this position of the nozzle cap 48 relative to the nozzle base 46 the axial grooves 144 of the cap inner cylindrical wall 136 are aligned with the spinner axial grooves 84 on the spinner shaft exterior surface 64 and with the straight channels 78 that communicate the spinner axial grooves 84 with the swirl chamber cavity 72.

Liquid that passes through the straight channels 78 is not spun but is directed toward the center axis 66 of the spinner shaft and the discharge orifice 114. This liquid is discharged through the discharge orifice 114 in a stream pattern. In addition, because an additional interior volume is provided in the indexing nozzle assembly 14 by the spacing 146 of the spinner shaft end surface 68 from the nozzle cap interior surface 118, any turbulence in the liquid in the swirl chamber cavity 72 is dampened by the liquid filling the additional volume of the spacing 146 and the spacing enhances the stream pattern of the liquid being discharged from the indexing nozzle assembly through the discharge orifice 114.

The indexing nozzle assembly of the present invention described above provides a nozzle cap mounted on a base of the assembly that can be rotated one-quarter turn in either direction from an off position of the nozzle cap to either a spray position or a stream position. In addition, further rotation of the cap from its spray or stream position in either direction of rotation will bring the cap back to an off position. Thus, the operation of the cap is simplified over that of prior art nozzle assemblies. Still further, the additional spacing provided in the interior of the indexing nozzle assembly adjacent the swirl chamber enhances the ability of the indexing nozzle assembly to discharge liquid in a stream pattern.

Although a particular embodiment of the trigger sprayer and indexing nozzle assembly of the invention have been described above, it should be understood that other modifications and variations could be made to the trigger sprayer and indexing nozzle assembly without departing from the scope of the invention defined by the following claims.

What is claimed is:

1. A trigger sprayer comprising:

a manually operated pump on the trigger sprayer;

a nozzle cap on the trigger sprayer, the nozzle cap having an end wall with an exterior surface and an opposite interior surface, a discharge orifice extending through the end wall and intersecting the exterior surface and the interior surface, the discharge orifice having a center axis and the nozzle cap being rotatable on the trigger sprayer about the center axis;

a liquid discharge passage extending through the trigger sprayer from the pump to the discharge orifice;

a liquid spinner positioned in the liquid discharge passage adjacent the nozzle cap interior surface and the discharge orifice with an axial spacing between the liquid spinner and the nozzle cap interior surface.

2. The trigger sprayer of claim 1, further comprising:

the axial spacing being from about 0.001 to about 0.010 of an inch.

3. The trigger sprayer of claim 1, further comprising:

the axial spacing being about 0.009 of an inch.

4. The trigger sprayer of claim 1, further comprising:

the nozzle cap interior surface consisting of a flat, circular surface around the discharge orifice.

5. The trigger sprayer of claim 1, further comprising:

the nozzle cap interior surface being a flat, circular surface around the discharge orifice, and the nozzle cap having a cylindrical interior surface that intersects the flat interior surface and engages around the liquid spinner.

6. The trigger sprayer of claim 1, further comprising:

the liquid spinner having an end surface that opposes the nozzle cap interior surface, a swirl chamber cavity is recessed into the end surface defining a swirl chamber in the liquid spinner, and the liquid spinner end surface is spaced by the axial spacing from the nozzle cap interior surface.

7. The trigger sprayer of claim 6, further comprising:

a plurality of channels recessed into the liquid spinner end surface, the plurality of channels communicating with the swirl chamber and extending radially outwardly through the spinner end surface from the swirl chamber.

8. The trigger sprayer of claim 7, further comprising:

several of the channels extending radially along lines that intersect the discharge orifice center axis and several of the channels extending radially along lines that do not intersect the discharge orifice center axis.

9. A trigger sprayer comprising:

a manually operated pump on the trigger sprayer;

a nozzle cap on the trigger sprayer, the nozzle cap having a discharge orifice with a center axis, the discharge orifice extending between an exterior surface of the nozzle cap and an interior surface of the nozzle cap inside the trigger sprayer;

a liquid discharge passage extending through the trigger sprayer from the pump to the discharge orifice; and a liquid spinner positioned in the liquid discharge passage adjacent the nozzle cap interior surface, the liquid spinner having a length that extends along a portion of the liquid discharge passage to an end surface of the liquid spinner that opposes the nozzle cap interior surface, a swirl chamber cavity is recessed into the end surface and the end surface is spaced from the nozzle cap interior surface.

10. The trigger sprayer of claim 9, further comprising:

the nozzle cap interior surface being a flat, circular surface that surrounds the discharge orifice.

11. The trigger sprayer of claim 10, further comprising:

a cylindrical interior wall in the nozzle cap that intersects with the cap interior surface and surrounds the swirl chamber cavity.

12. The trigger sprayer of claim 9, further comprising:

the liquid spinner end surface being spaced from the nozzle cap interior surface by a distance from about 0.001 to about 0.01 of an inch.

13. The trigger sprayer of claim 9, further comprising:

the liquid spinner end surface being spaced from the nozzle cap interior surface by a distance of about 0.009 of an inch.

14. The trigger sprayer of claim 9, further comprising:

the liquid spinner having a cylindrical exterior surface and a plurality of channels recessed into the liquid spinner end surface and extending radially between the swirl chamber cavity and the liquid spinner exterior surface.

15. The trigger sprayer of claim 14, further comprising:

several of the channels extend radially along lines that intersect the discharge orifice center axis and several of the channels extend radially along lines that do not intersect the discharge orifice center axis.

16. The trigger sprayer of claim 9, further comprising:

the nozzle cap being rotatable on the trigger sprayer.

* * * * *